US007945448B2

(12) United States Patent
Wang et al.

(10) Patent No.: US 7,945,448 B2
(45) Date of Patent: May 17, 2011

(54) PERCEPTION-AWARE LOW-POWER AUDIO DECODER FOR PORTABLE DEVICES

(75) Inventors: Ye Wang, Singapore (SG); Samarjit Chakraborty, Singapore (SG); Wendong Huang, Singapore (SG)

(73) Assignee: National University of Singapore, Singapore (SG)

( * ) Notice: Subject to any disclaimer, the term of this patent is extended or adjusted under 35 U.S.C. 154(b) by 930 days.

(21) Appl. No.: 11/792,019

(22) PCT Filed: Nov. 28, 2005

(86) PCT No.: PCT/SG2005/000405

§ 371 (c)(1), (2), (4) Date: Aug. 29, 2007

(87) PCT Pub. No.: WO2006/057626

PCT Pub. Date: Jun. 1, 2006

(65) Prior Publication Data

US 2007/0299672 A1 Dec. 27, 2007

Related U.S. Application Data

(60) Provisional application No. 60/631,134, filed on Nov. 29, 2007.

(51) Int. Cl.
*G10L 21/00* (2006.01)

(52) U.S. Cl. ..... 704/500

(58) Field of Classification Search ..... 704/500
See application file for complete search history.

(56) References Cited

U.S. PATENT DOCUMENTS

| | | | | |
|---|---|---|---|---|
| 5,706,290 | A * | 1/1998 | Shaw et al. | 370/465 |
| 5,809,474 | A | 9/1998 | Park | |
| 2004/0010329 | A1 | 1/2004 | Lee et al. | |

OTHER PUBLICATIONS

Extended European Search Report for Application No. 05807683.7, mailed on Jul. 5, 2010.

He Dongmei, Gao Wen, Wu Jiangqin: Complexity scalable audio coding algorithm based on wavelet packet decomposition Proceedings of the 5th International Conference on Signal Processing, 2000. WCCC-ICSP 2000, vol. 2, Aug. 21, 2000-Aug. 25, 2000 pp. 659-665, XP002588048, ISBN: 0-7803-5747-7.

Argenti F et al: "Audio decoding with frequency and complexity scalability" IEE Proceedings: Vision, Image and Signal Processing, Institution of Electrical Engineers, GB LNKD-DOI:10.1049/IP-VIS:20020385, vol. 149, No. 3, Jun. 21, 2002, pp. 152-158, XP006018428, ISSN: 1350-245X.

(Continued)

*Primary Examiner* — Susan McFadden

(74) *Attorney, Agent, or Firm* — Schwabe, Williamson & Wyatt, P.C.

(57) ABSTRACT

A method of decoding audio data representing an audio clip, said method comprising the steps of selecting one of a predetermined number of frequency bands; decoding a portion of the audio data representing said audio clip according to the selected frequency band, wherein a remaining portion of the audio data representing said audio clip is discarded; and converting the decoded portion of audio data into sample data representing the decoded audio data.

23 Claims, 8 Drawing Sheets

OTHER PUBLICATIONS

Miyoshi A et al: "Critical Power Slope: Understanding the Runtime Effects of Frequency Scaling" Conference Proceedings of the 2000 International Conference on Supercomputing ICS'02. New York, NY, Jun. 22-26, 2002; [ACM International Conference on Supercomputing], New York, NY: ACM, US LNKD-DOI:10.1145/514191.514200, vol. Conf. 16, Jun. 22, 2002, pp. 35-44, XP001171500, ISBN: 978-1-58113-483-4.

Acquaviva A et al: "Processor frequency setting for energy minimization of streaming multimedia application" Proceedings of the 9th International Workshop on Hardware/Software Codesign. Codes 2001. Copenhagen, Denmark, Apr. 25-27, 2001; [Proceedings of the International Workshop on Hardware/Software Codesign], New York, NY: ACM US, Apr. 25, 2001, pp. 249-253, XP010543449, ISBN: 978-1-58113-364-6.

Chakraborty S et al: "A perception-aware low-power software audio decoder for portable devices" Embedded Systems for Real-Time Multimedia, 2005. 3rd Workshop on Jersey City, NJ, USA Sep. 19, 2005, Piscataway, NJ, USA, IEEE LNKD-DOI: 10.1109/ESTMED.2005-.1518060, Sep. 19, 2005, pp. 13-18, XP010842005, ISBN: 978-0-7803-9347-9.

Acquaviva, et al.; Software-Controlled Processor Speed Setting for Low-Power Streaming Multimedia; IEEE Transactions on Computer-Aided Design of Integrated Circuits and Systems; Nov. 2001; pp. 1283-1292; vol. 20, No. 11.

Atmel Introduces an Ultra Low Power MP3 Decoder for Mobile Phone Applications, Atmel Corporation; PRNewswire; http:\www.atmel.com/products/pm3/, Oct. 2004; 2 pages.

Austin, et al.; SimpleScalar: An Infrastructure for Computer System Modeling; IEEE Computer; Feb. 2002; pp. 59-67; vol. 35, No. 2.

Cai, et al.; Dynamic Power Management Using Data Buffers; Design, Automation and Test in Europe Conference and Exhibition; 2004; 6 pages; IEEE.

Choi et al.; Frame-Based Dynamic Voltage and Frequency Scaling for a MPEG Decoder; ICCAD; 2002, pp. 732-737; IEEE.

Choi et al.; Off-Chip Latency-Driven Dynamic Voltage and Frequency Scaling for an MPEG Decoding; DAC; 2004; pp. 544-549; ACM.

Qu et al.; Energy Minimization with Guaranteed Quality of Service; ISLPED; 2000; pp. 43-48; ACM.

Hughes et al.; Saving Energy with Architectural and Frequency Adaptations for Multimedia Applications; Proceedings of the 34th Annual International Symposium on Microarchitecture; Dec. 2001; pp. 1-12.

Im et al.; Dynamic Voltage Scheduling with Buffers in Low-Power Multimedia Applications; ACM Transactions on Embedded Computing Systems; 2004; pp. 686-705; vol. 3, No. 4; ACM.

ISO/IEC 11172-3; Coding of Moving Pictures and Associated Audio for Digital Storage Media at up to About 1.5 MBIT/s; 1993; 39 pages.

Keutzer et al.; System-Level Design: Orthogonalization of Concerns and Platform-Based Design; IEEE Transactions on Computer-Aided Design of Integrated Circuits and Systems; Dec. 2000; pp. 1523-1543; vol. 19, No. 12.

Lu et al.; Dynamic Frequency Scaling With Buffer Insertion for Mixed Workloads; IEEE Transactions on Computer-Aided Design of Integrated Circuits and Systems; Nov. 2002; pp. 1284-1305; vol. 21, No. 11.

Maxiaguine et al.; Tuning SoC Platforms for Multimedia Processing; Identifying Limits and Tradeoffs; CODES+ISSS; Sep. 2004; 6 pages; ACM.

Mesarina et al.; Reduced Energy Decoding of MPEG Streams; ACM/SPIE Multimedia Computer and Networking (MMCN) Jan. 18-25, 2002; 13 pages; SPIE; San Jose, CA.

Mock; Music Everywhere; It's All About the Algorithm-But Which One Will Win?; IEEE Spectrum; Sep. 2004; pp. 42-47.

Servetti et al.; Perception-Based Partial Encryption of Compressed Speech; IEEE Transactions on Speech and Audio Processing; Nov. 2002; pp. 637-643; vol. 10, No. 8.

Wang et al.; A Framework for Robust and Scalable Audio Streaming; In ACM Multimedia; Oct. 2004; pp. 144-151; ACM.

Yuan, et al.; Energy-Efficient Soft Real-Time CPU Scheduling for Mobile Multimedia Systems; 19th ACM Symposium on Operating Systems Principles (SOSP), Oct. 19-22, 2003; pp. 149-163; ACM.

Pedram; Design Technology for Low Power VLSI; Encylcopedia of Computer Science and Technology; 1995; pp. 1-32.

Haid et al.; Design of an Energy-Aware System-In-Package for Playing MP3 in Wearable Computing Devices; Proc. of Telecommunications and Mobile Computing, Graz University of Technology, 2003; 4 pages; Austria.

De Smet et al.; Do Not Zero-Pute: An Efficient Homespun MPEG-Audio Layer II Decoding and Optimization Strategy; Proc. of ACM Multimedia; Oct. 10-16, 2004; pp. 376-379; ACM; New York.

Yuan et al.; Practical Voltage Scaling for Mobile Multimedia Devices; Proc. of ACM Multimedia, Oct. 10-16, 2004; 8 pages; ACM.

Grill; A Bit Rate Scalable Perceptual Coder for MPEG-4 Audio; 103rd AES Convention; 1997; preprint 4620.

Argenti et al.; Audio Decoding with Frequency and Complexity Scalability; IEE Proc.-Vision Image and Signal Processing; Jun. 2002; pp. 152-158; vol. 149, No. 3.

International Search Report for Application PCT/SG2005/000405, mailed Jan. 10, 2006.

International Preliminary Report on Patentability for Application PCT/SG2005/000405, mailed Nov. 22, 2006.

Office Action for Chinese Application 2005800474100, mailed Jul. 6, 2009.

* cited by examiner

PERCEPTION-AWARE LOW-POWER AUDIO DECODER FOR PORTABLE DEVICES

FIELD OF THE INVENTION

The present invention relates generally to low-power decoding in multimedia applications and, in particular, to a method and apparatus for decoding audio data, and to a computer program product including a computer readable medium having recorded thereon a computer program for decoding audio data.

BACKGROUND

Increasingly, many portable consumer electronics devices, such as mobile phones, portable digital assistants (PDA) and portable audio players comprise embedded computer systems. These embedded computer systems are typically configured according to general-purpose computer hardware platforms or architecture templates. The only difference between these consumer electronic devices is typically the software application that is being executed on the particular device. Further, several different functionalities are increasingly being clubbed into one device. For example, some mobile phones also work as portable digital assistants (PDA) and/or portable audio players. Accordingly, there has been a shift of focus in the portable embedded computer systems domain towards appropriate software-implementations of different functionalities, rather than tailor-made hardware for different applications.

Power consumption of the computer systems embedded in the portable devices is probably the most critical constraint in the design of both, hardware and software, for such portable devices. One known method of minimising power consumption of computer systems embedded in portable devices is to dynamically scale the voltage and frequency (i.e., clock frequency) of the processor of an embedded computer system in response to the variable workload involved in processing multimedia streams.

Another known method of minimising power consumption of computer systems embedded in portable devices uses buffers to smooth out multimedia streams and decouple two architectural components having different processing rates. This enables the embedded processor to be periodically switched off or for the processor to be run at a lower frequency, thereby saving energy. There are also a number of known scheduling methods addressed at the problem of maintaining a Quality-of-Service (QoS) requirement associated with multimedia applications and at the same time minimizing power consumption of an embedded computer system.

SUMMARY

It is an object of the present invention to substantially overcome, or at least ameliorate, one or more disadvantages of existing arrangements.

According to one aspect of the present invention there is provided a method of decoding audio data representing an audio clip, said method comprising the steps of:

selecting one of a predetermined number of frequency bands;

decoding a portion of the audio data representing said audio clip according to the selected frequency band, wherein a remaining portion of the audio data representing said audio clip is discarded; and converting the decoded portion of audio data into sample data representing the decoded audio data.

According to another aspect of the present invention there is provided a decoder for decoding audio data representing an audio clip, said method comprising the steps of:

decoding level selection means for selecting one of a predetermined number of frequency bands;

decoding means for decoding a portion of the audio data representing said audio clip according to the selected frequency band, wherein a remaining portion of the audio data representing said audio clip is discarded; and data conversion means for converting the decoded portion of audio data into sample data representing the decoded audio data.

According to still another aspect of the present invention there is provided a portable electronic device comprising:

decoding level selection means for selecting one of a predetermined number of frequency bands;

decoding means for decoding a portion of audio data representing an audio clip according to the selected frequency band, wherein a remaining portion of the audio data representing said audio clip is discarded; and data conversion means for converting the decoded portion of audio data into sample data representing the decoded audio data.

Other aspects of the invention are also disclosed.

BRIEF DESCRIPTION OF THE DRAWINGS

One or more embodiments of the present invention will now be described with reference to the drawings and appendices, in which.

DETAILED DESCRIPTION INCLUDING BEST MODE

Figure 1:
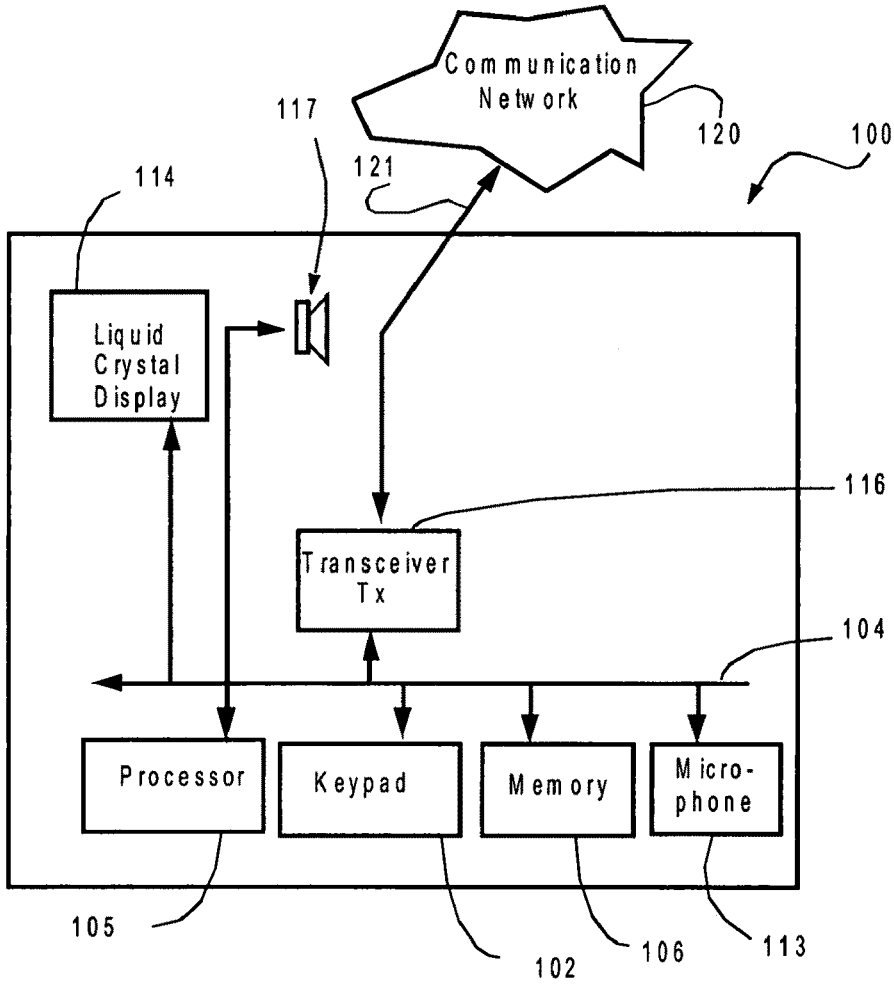
FIG. 1 is a schematic block diagram of a portable computing device comprising a processor, upon which embodiments described can be practiced.

Where reference is made in any one or more of the accompanying drawings to steps and/or features, which have the same reference numerals, those steps and/or features have for the purposes of this description the same function(s) or operation(s), unless the contrary intention appears.

It is to be noted that the discussions contained in the "Background" section and that above relating to prior art arrangements relate to discussions of documents or devices which form public knowledge through their respective publication and/or use. Such should not be interpreted as a representation by the present inventor(s) or patent applicant that such documents or devices in any way form part of the common general knowledge in the art.

Most perceptual audio coder/decoders (i.e., codecs) are designed to achieve transparent audio quality at least at high bit rates. The frequency range of a high quality audio codec such as MP3 is up to about 20 kHz. However, most adults, particularly older ones, can hardly hear frequency components above 16 kHz. Therefore, it is unnecessary to determine the perceptually irrelevant frequency components. Further, within the wide swath of frequencies that most people can hear, some bands register more loudly than others. In general, the high frequency bands are perceptually less important than the low frequency bands. There is little perceptual degradation if some high frequency components are left un-decoded. A standard decoder such as an MP3 decoder will simply decode everything in an input bit stream without considering the hearing ability of individual users with or without hearing loss. This results in a significant amount of irrelevant computation, thereby wasting battery power of a portable computing device or the like using such a decoder.

A method 800 of decoding audio data in the form of a coded bit stream, in accordance with the preferred embodiment, is described below with reference to FIGS. 1 to 8. The principles of the preferred method 800 described herein have general applicability to most existing audio formats. However, for ease of explanation, the steps of the preferred method 800 are described with reference to the MPEG 1, Layer 3 audio formats also known as MP3, audio format. MP3 is a non-scalable codec and has widespread popularity. The method 800 is particularly applicable to non-scalable codecs like MP3 and also Advanced Audio Coding (AAC). Non-scalable codecs incur a lower workload and are more popular than scalable codecs, such as an MPEG-4 scalable codec, where only a base layer is typically decoded with an enhancement layer being ignored.

The method 800 integrates an individual user's own judgment on the desired audio quality allowing a user to switch between multiple output quality levels. Each such level is associated with a different level of power consumption, and hence battery lifetime. The described method 800 is perception-aware, in the sense that the difference in the perceived output quality associated with the different levels is relatively small. But decoding the same audio data, such as an audio clip in the form of a coded bit stream, at a lower output quality level leads to significant savings in the energy consumed by the processor embedded in a portable device.

To evaluate the perceptual quality of any audio codec, rigorous subjective listening tests are carried out. These tests are usually conducted in a quiet environment with high quality headphones by expert listeners or panels without any hearing loss. However, the realistic environments for ordinary users are usually very different. Firstly, it is relatively rare for a portable audio player to be used in a quite environment, for example in the living room of one's home. It is far more common to use portable audio players on the move and in a variety of environments such as in a bus, train, or in a flight, using simple earpieces. These differences have important implications on the audio quality required.

According to experiments carried out by the present inventors, it is hard for most users to distinguish between Compact Disc (CD) and Frequency Modulation (FM) quality audio in a noisy environment. Most users appear to be more tolerant to a small quality degradation in such environments. The method 800 enables the user to change the decoding profile to adapt to the listening environment, while a standard MP3 decoder cannot.

Different applications and signals require different bandwidth. For example, a story-telling audio clip requires significantly less bandwidth compared to a music clip. The method 800 allows the user to choose an appropriate decoding profile suitable for the particular service and signal type also prolonging the battery life of a portable computing device using the method 800. The method 800 allows users to control the tradeoff between the battery life and the decoded audio quality, with the knowledge that slightly degraded audio quality (this degradation may not even be perceptible to the particular user) can significantly increase the battery life of a portable audio player, for example. This feature allows the user to tailor the acceptable quality level of the decoded audio according to their hearing ability, listening environment and service type. For example, in a quiet environment the user may prefer perfect sound quality with more power consumption. On the other hand, the user might prefer a longer battery life with slightly degraded audio quality during a long haul flight.

The method 800 is preferably practiced using a battery-powered portable computing device 100 (e.g., a portable audio (or multi-media) player, a mobile (multi-media) telephone, a PDA or the like) such as that shown in FIG. 1. The processes of FIGS. 2 to 8 may be implemented as software, such as a software program executing within the portable computing device 100. In particular, the steps of the method 800 are effected by instructions in the software that are carried out by the portable computing device 100. The instructions may be formed as one or more software modules, each for performing one or more particular tasks. The software may also be divided into two separate parts, in which a first part performs the method 800 and a second part manages a user interface between the first part and the user. The software may be stored in a computer readable medium, including the storage devices described below, for example. The software may be loaded into the portable computing device 100 by a manufacturer, for example, from the computer readable medium, via a serial link and then be executed by the portable computing device 100. A computer readable medium having such software or computer program recorded on it is a computer program product. The use of the computer program product in the computer system 100 preferably effects an advantageous apparatus for implementing the described method 800.

The portable computing device 100 includes at least one processor unit 105, and a memory unit 106, for example formed from semiconductor random access memory (RAM) and read only memory (ROM). The portable computing device 100 may also comprise a keypad 102, a display 114 such as a liquid crystal display (LCD), a speaker 117 and a microphone 113. The portable computing device 100 is preferably powered by a battery. A transceiver device 116 is used by the portable computing device 100 for communicating to and from a communications network 120 (e.g., the telecommunications network), for example, connectable via a wireless communications channel 121 or other functional medium. The components 105 to 117 of the portable computing device 100 typically communicate via an interconnected bus 104.

Typically, the application program is resident in ROM of the memory device 106 and is read and controlled in its execution by the processor 105. Still further, the software can also be loaded into the portable computing device 100 from other computer readable media. The term "computer readable medium" as used herein refers to any storage or transmission medium that participates in providing instructions and/or data to the portable computing device 100 for execution and/or processing.

The method 800 may alternatively be implemented in dedicated hardware unit comprising one or more integrated circuits performing the functions or sub functions of the described method.

In accordance with the method 800, a decoding level selected by a user to decode any audio clip determines the frequency with which the processor 105 is to be executed. In contrast to many known dynamic voltage/frequency scaling methods, the method 800 does not involve any runtime scaling of the processor 105 voltage or frequency. If the processor 105 has a fixed number of voltage-frequency operating points, the decoding levels in the method 800 may be tuned to match these operating points.

In the method 800, the frequency bandwidth of the portable computing device 100 comprising an audio decoder (e.g., an MP3 decoder) implemented therein, is partitioned into a number of groups that is equal to the number of decoding levels. These groups are preferably ordered according to their perceptual relevance, which will be described in detail below. If there are four levels of decoding (i.e. Levels 1-4) then the frequency bandwidth group that has the highest perceptual relevance may be associated with Level 1 and the group that has the lowest perceptual relevance may be associated with Level 4. Such a partitioning of the frequency bandwidth into four levels in the case of MP3 is shown in Table 1 below. Column 2 of Table 1 (i.e., Decoded subband index) is described below.

TABLE 1

| Decoding level | Decoded subband index | Frequency range (Hz) | Perceived quality level |
|---|---|---|---|
| Level 1 | 0-7 | 0-5512.5 | AM quality |
| Level 2 | 0-15 | 0-11025 | Near FM quality |
| Level 3 | 0-23 | 0-16537.5 | Near CD quality |
| Level 4 | 0-31 | 0-22050 | CD quality |

The processor 105 implementing the steps of the method 800 may be referred to as a "Perception-aware Low-power MP3 (PL-MP3)" decoder. The method 800 is not only useful with general-purpose voltage and frequency scalable processors, but also with general-purpose processors without voltage and frequency scalability.

The method 800 may also be used with a processor that does not allow frequency scaling and is not powerful enough to do full MP3 decoding. In this instance, the method 800 may be used to decode regular MP3 files at a relative lower quality.

Figure 2:
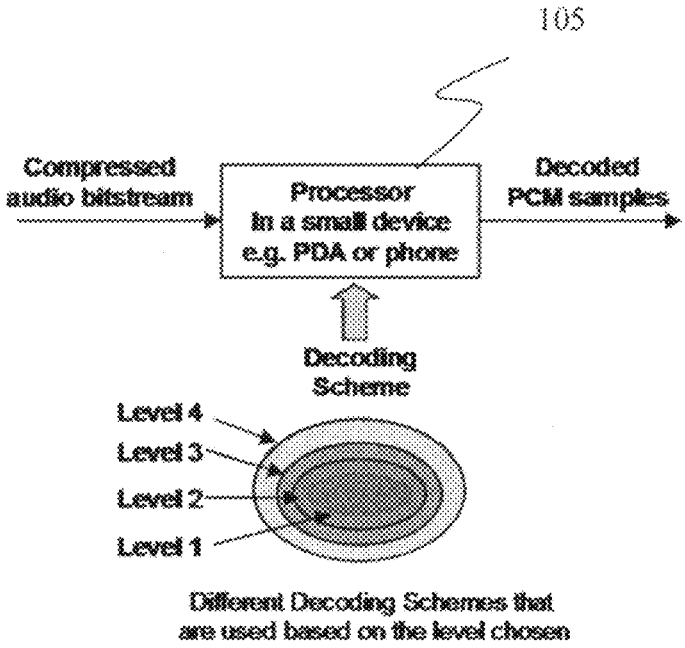
FIG. 2 shows the processor of FIG. 1 taking a coded bitstream as input and producing a stream of decoded pulse code modulated (PCM) samples.

The method 800 allows a user to choose a decoding level (i.e., one of four such levels) depending on processing power supplied by the processor 105. The method 800 is executed by the processor 105 based on the decoding level selected by the user. Each level is associated with a different level of power consumption and a corresponding output audio quality level. The processor 105 takes audio data in the form of a coded bit stream as input and produces a stream of decoded data in the form of pulse code modulated (PCM) samples, as seen in FIG. 2. The method 800 may be applied to decode a coded bit stream that is being downloaded or streamed from a network. The method 800 may also be used to decode an audio clip in the form of a coded bit stream stored within the memory 106, for example, of the portable computing device 100.

When an audio clip in the form of a coded bit stream is decoded at Level 1, only the frequency range 0 to 5512.5 Hz associated with this level is decoded. At higher levels (i.e., Level 2 to 3), a larger frequency range is decoded and finally at Level 4, the entire frequency range is decoded. Although the computational workload associated with the method 800 scales almost linearly with the decoding level, the lower frequency ranges have a much higher perceptual relevance compared to the higher ones, as described above. Therefore, when an audio clip is decoded at a lower level, by sacrificing only a small fraction of the output quality, the processor 105 may be run at a much lower frequency (i.e., clock frequency) and voltage, when compared to a higher decoding level.

Recently a number of hardware implementations of audio decoders have been developed. Some of these hardware implementations include hardwired decoder chips which have been designed for very low power consumption. An example of such a decoder chip is the ultra low-power MP3 decoder from Atmel Corporation™, which is designed especially to handle MP3 ring tones in mobile phones.

The method 800 lowers the power consumption of the processor 105 executing the software implementing the steps of the method 800. The method 800 does not rely on any specific hardware implementations or on any co-processors to implement specific parts of the decoder. The method 800 is very useful for use with PDAs, portable audio players or mobile phones and the like comprising powerful voltage and frequency scalable processors, which may all be used as portable audio/video players.

Figure 3:
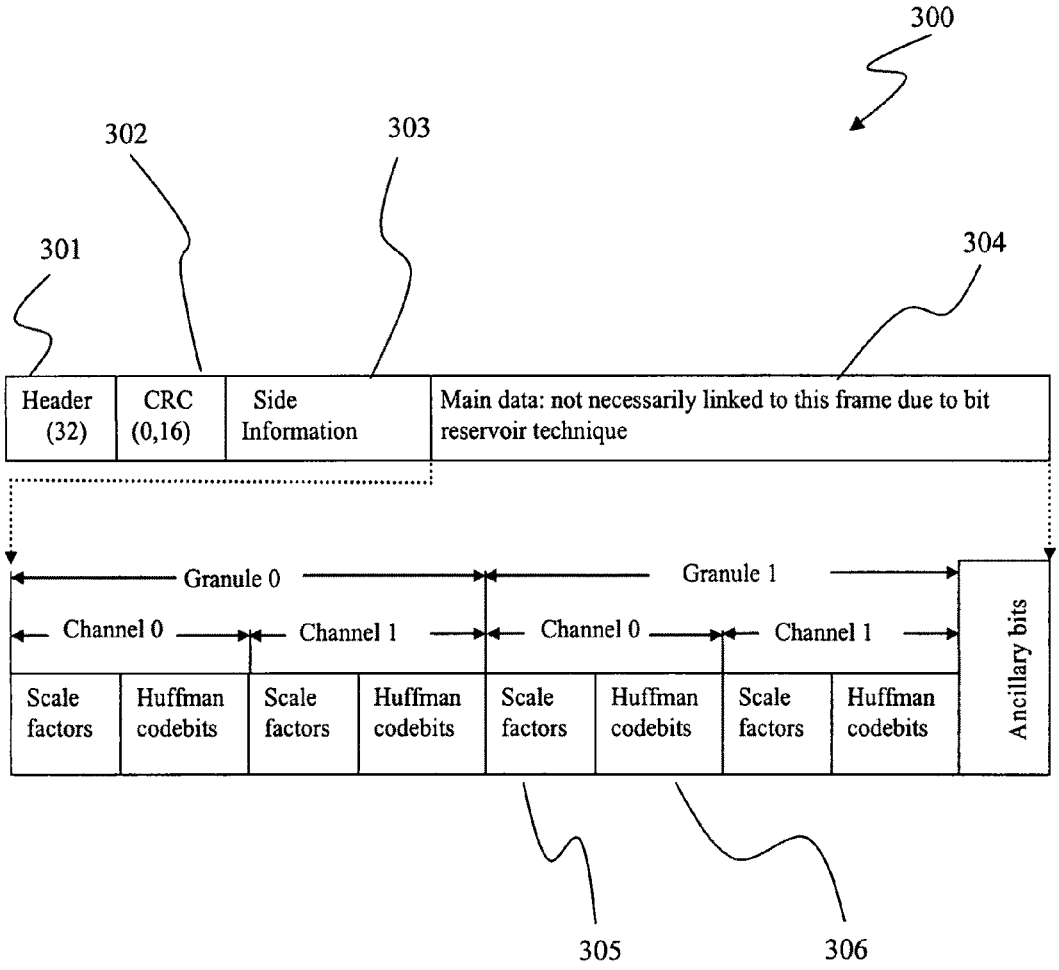
FIG. 3 shows the frame structure of an MPEG 1, Layer 3 (i.e., MP3) standard bitstream.

Like many other multimedia bitstreams, the MP3 bitstream has a frame structure, as seen in FIG. 3. A frame 300 of the MP3 bitstream contains a header 301, an optional CRC 302 for error protection, a set of control bits coded as side information 303, followed by the main data 304 consisting of two granules (i.e., Granule 0 and Granule 2) which are the basic coding units in MP3. For stereo audio, each granule (e.g., Granule 1) contains data for two channels, which consists of scale factors 305 and Huffman coded spectral data 306. It is also possible to have some ancillary data inserted at the end of each frame. The method 800 processes such an MP3 bit stream frame by frame or granule by granule.

Figure 4:
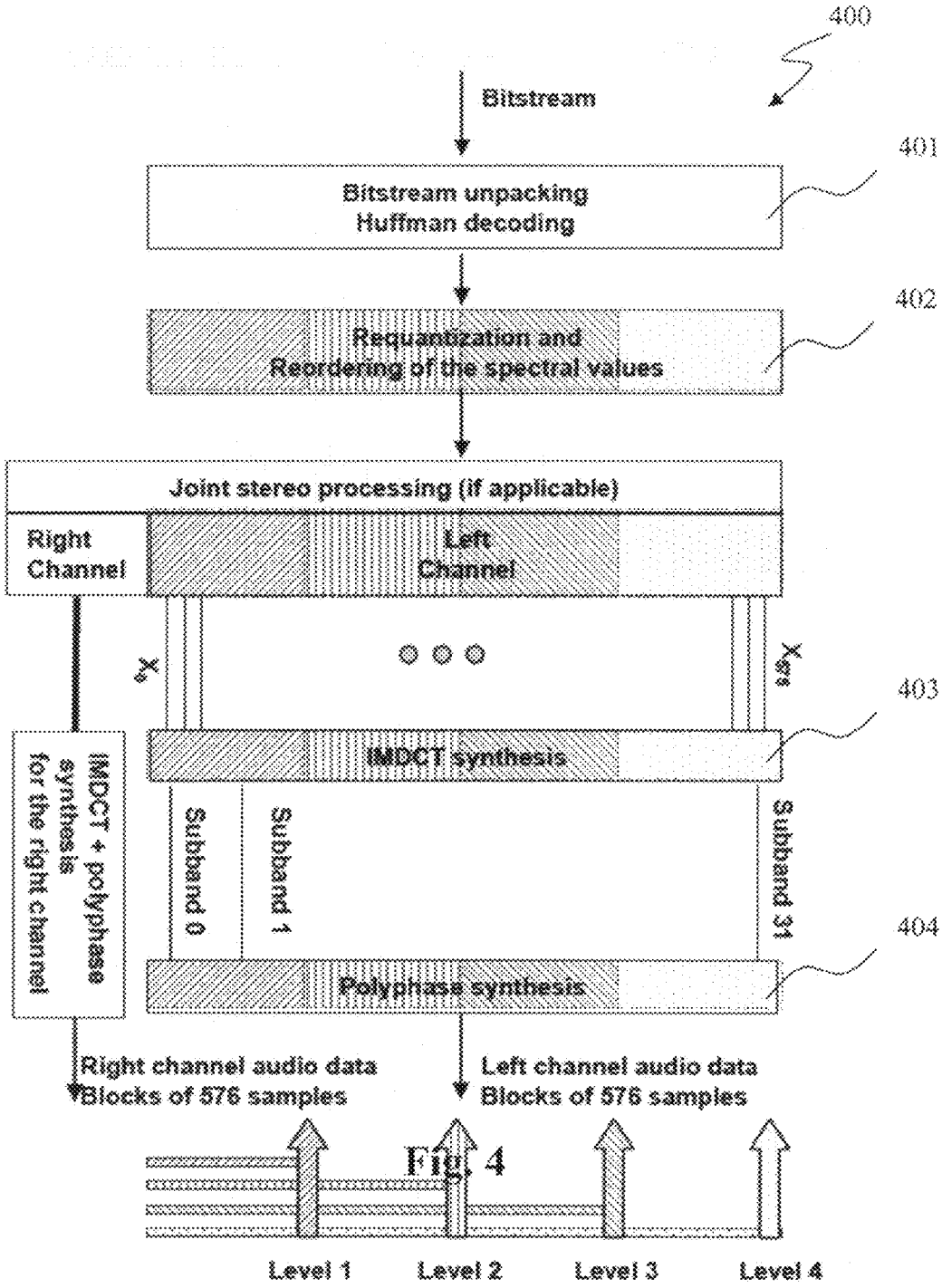
FIG. 4 is a block diagram showing the modules of a standard MP3 decoder together with the proposed new decoder architecture.
Figure 5:
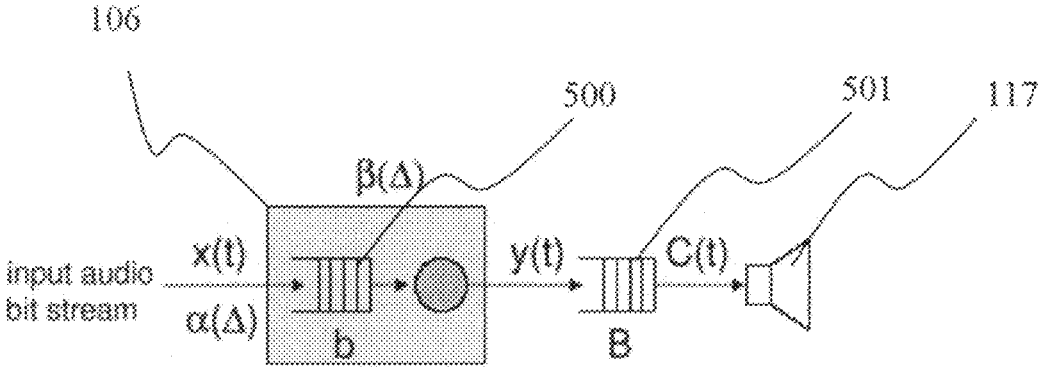
FIG. 5 shows an internal buffer and playout buffer used by the processor of FIG. 1 in decoding audio data.
Figure 8:
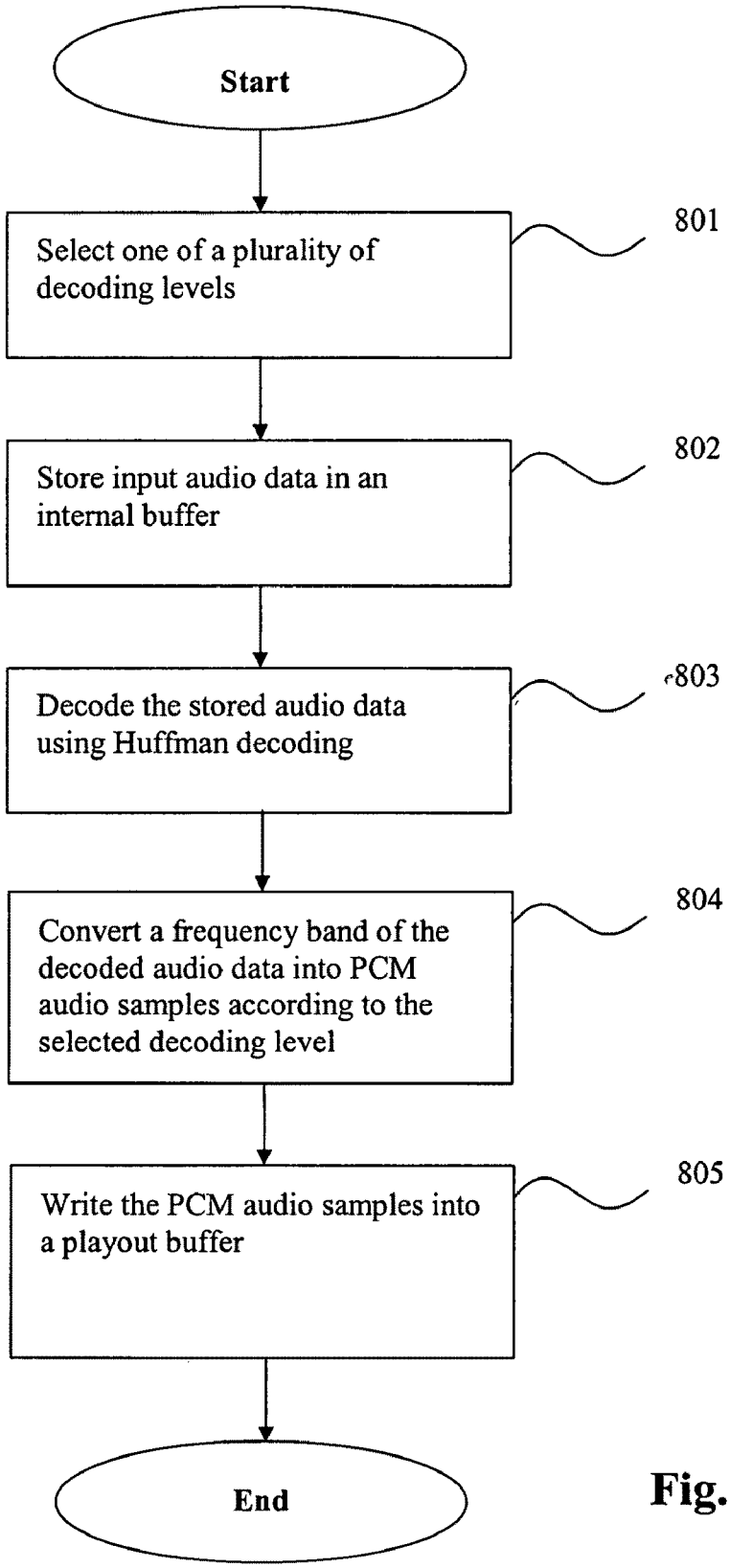
FIG. 8 shows a method of decoding audio data in the form of a coded bit stream, in accordance with the preferred embodiment.

The method 800 of decoding audio data will now be described with reference to FIG. 8. The method 800 may be implemented as software resident in the ROM 106 and being controlled in its execution by the processor 105. The portable computing device 100 implementing the method 800 may be configured in accordance with a standard MP3 audio decoder 400 as seen in FIG. 4. Each of the steps of the method 800 may be implemented using separate software modules.

The method 800 begins at the first step 801, where the one of the four decoding levels (i.e., Levels 1-4) of Table 1 are selected. For example, the user of the portable computing device 100 may select one of the four decoding levels using the keypad 102. The processor 105 may store a flag in the RAM of the memory 106 indicating which one of the four decoding levels has been selected.

At the next step 802, the processor 105 parses data in the form of a coded input bit stream and stores the data in an internal buffer 500 (see FIG. 5) configured within the memory 106. The internal buffer 500 will be described in more detail below. Then at step 803, the processor 105 decodes the side information of the stored data using Huffman decoding. Step 803 may be performed using a software module such as the Huffman decoding software module 401 of the standard MP3 decoder 400, as seen in FIG. 4.

The method 800 continues at the next step 804, where the processor 105 converts a frequency band of the decoded audio data into PCM audio samples, according to the decoding level selected at step 801. For example, if Level 1 was selected at step 801, then the decoded audio data in the frequency range 0 to 5512.5 Hz will be converted into PCM audio samples at step 804. Step 804 may be performed by software modules such as the dequantization software module 402, the inverse modified discrete cosine transform (IMDCT) software module 403 and the polyphase synthesis software module 404 of the standard MP3 decoder 400 as seen in FIG. 4.

The method 800 concludes at the next step 805, where the processor 105 writes the PCM audio samples into a playout buffer 501 (see FIG. 5) configured within memory 106. This playout buffer 501 may then be read by the processor 105 at some specified rate and be output as audio via the speakers 117.

The three modules of a standard MP3 decoder 400, which incur the highest workload are the de-quantization module 402, the IMDCT module 403 and the polyphase synthesis filterbank module 404. Traditionally, the standard MP3 decoder 400 decodes the entire frequency band, which corresponds to the highest computational workload. As seen in FIG. 4, in accordance with the preferred method 800, depending on the decoding level (i.e., Levels 1 to 3), the de-quantization module 402, the IMDCT module 403 and the polyphase synthesis filterbank module 403 process only a partial frequency range and thereby incur less computational cost.

There are several known optimization methods used for memory and/or computationally efficient implementations such as the "Do Not Zero-Pute" algorithm described by De Smet et al in the publication entitled "*Do Not Zero-Pute: An Efficient Homespun MPEG-Audio Layer II Decoding and Optimisation Strategy*", In Proc. Of ACM Multimedia 2004, Oct. 2004. The Do Not Zero-Pute algorithm tries to optimize the polyphase filterbank computation in the MPEG 1 layer II by eliminating costly computing cycles being wasted at processing useless zero-valued data. The present inventors classify this kind of approach as eliminating redundant computation. In contrast, the method 800 partitions the workload according to frequency bands with different perceptual relevance and allows the user to eliminate the irrelevant computation.

The reduction of workload in the three computationally most demanding modules, namely the de-quantization module 402, the IMDCT module 403 and the polyphase synthesis filterbank module 404, is expressed in the following Equations (1) to (4).

The computation required to be performed by the processor 105 for the de-quantization of a granule (in the case of long blocks) is expressed as Equation (1) as follows:

$$xr_i = \mathrm{sign}(is_i) * |is_i|^{\frac{4}{3}} * 2^{\frac{1}{4}(\mathrm{global_gain}[gr]-210)} * 2^{-(\mathrm{scalefac_multiplier} * (\mathrm{scalefac_}[sfb][ch][gr] + preflag[gr] * pretab[sfb]))} \quad (1)$$

where $is_i$ is the i-th input coefficient being dequantized, sign ($is_i$) is the sign of $is_i$, global_gain is the logarithmical quantizer step size for the entire granule gr. Scalefac_multiplier is the multiplier for scale factorbands. $\mathrm{Scalefac}_{13}$ 1 is the logarithmically quantized factor for scale factorband sfb of channel ch of granule gr. Preflag is the flag for additional high frequency amplification of the quantized values. Pretab is the preemphasis table for scale factorbands. $xr_i$ is the i-th dequantized coefficient.

For the standard MP3 decoder 400 not executing the steps of the method 800, i=0,1, . . . N−1 and N=576, while i=0, 1, . . . , sbl*18−1 for the processor 105 of such a decoder 400 executing the steps of the method 800. For example, the range for Level 1 is reduced to i=0,1 , . . . 143.

The computation required for the IMDCT module 403 may be expressed in accordance with Equation (2) as follows:

$$x_i = \sum_{k=0}^{n/2-1} X_k \cos\left(\frac{\pi}{2n}\left(2i + 1 + \frac{n}{2}\right)(2k+1)\right) \quad (2)$$

for i=0,1, . . . , n−1 and n=36, where $X_k$ is the k-th input coefficient for IMDCT operations and $x_i$ is the i-th output coefficient. For the standard MP3 decoder 400 not executing the method 800 all 32 subbands are determined, while only sbl≦32 subbands are calculated in accordance with the preferred method 800.

The computation required for the matrixing operation of the polyphase synthesis filterbank module 404 is expressed as:

$$V_i = \sum_{k=0}^{n-1} S_k \cos(\pi(2k+1)(n/2+i)/2n) \quad (3)$$

$$i = 0, 1, \ldots, 2n-1 \text{ and } n = 32.$$

In accordance with the method 800, Equation (3) becomes Equation (4) as follows:

$$V_i = \sum_{k=0}^{sbl-1} S_k \cos(\pi(2k+1)(n/2+i)/2n) \quad (4)$$

where $S_k$ is the k-th input coefficient for polyphase synthesis operations and $V_i$ is the i-th output coefficient. Equation (4) shows the computational workload of the processor 105 implementing the method 800 decreases linearly with the bandwidth.

After the bitstream unpacking of step 802 (i.e., as performed by the Huffman decoding module 401), which require only a small percentage of the total computational workload (4% in our examples), the workload associated with the subsequent step 804 (i.e., as performed by the modules 402, 403 and 404) can be partitioned. A granularity may be selected that corresponds to all the 32 subbands defined in the MPEG 1 audio standard. However, for the sake of simplicity, in accordance with the preferred method 800, these 32 subbands are partitioned into only four groups, where each group corresponds to a decoding level, as seen in FIG. 4 and Table 1.

As described above, the decoding Level 1 covers the lowest frequency bandwidth (0-5.5 kHz) which may be defined as the base layer. Although the base layer occupies only a quarter of the total bandwidth and contributes to roughly a quarter of the total computational workload performed by the processor 105 in decoding an audio clip, the base layer is perceptually the most relevant frequency band. The output audio quality corresponding to Level 1 of Table 1 is certainly sufficient for services like news and sports commentary. Level 2 covers a bandwidth of 11 kHz and almost reaches the FM radio quality, which is sufficiently good even for listening to music clips, especially in noisy environments. Level 3 covers a bandwidth of 16.5 kHz and produces an output that is very close to CD quality. Finally, Level 4 corresponds to the standard MP3 decoder, which decodes the full bandwidth of 22 kHz.

Levels 1, 2 and 3 process only a part of the data representing the different frequency components, whereas Level 4 processes all the data and is therefore computationally more expensive. The audio quality corresponding to levels 3 and 4 are almost indistinguishable in noisy environments, but are associated with substantially different power consumption levels.

Although each of the four frequency bands requires roughly the same workload, their perceptual contributions to the overall QoS are vastly different. In general, the low frequency band (i.e., Level 1) is significantly more important than any of the higher frequency bands.

The minimum operating frequency of the processor 105 for decoding audio data, in accordance with the method 800 at any particular decoding level, may be determined. The computed frequency can then be used to estimate the power consumption due to the processor 105. The variability in the number of bits constituting a granule and also the variability in the processor cycle requirement in processing any granule is taken into account. By accounting for this variability, the change in processor 105 frequency requirement when the playback delay of the portable computing device 100 is changed may be determined.

As described above and as seen in FIG. 5, the processor 105 uses the internal buffer 500 of size b, configured within memory 106, in decoding audio data in the form of an audio bit stream (e.g., an audio clip). The decoded audio stream, which is a sequence of PCM samples, is written into the playout buffer 501 of size B configured within memory 106. This playout buffer 501 is read by the processor 105 at some specified rate.

Assuming that the input bitstream to be decoded is fed into the internal buffer 500 at a constant rate of r bits/sec. The number of bits constituting a granule in the MP3 frame structure is variable. The maximum number of bits per granule can almost be three times the minimum number of bits in a granule, where this minimum number is around 1200 bits. To characterize this variability, two functions $\phi^l(k)$ and $\phi^u(k)$ may be used, where $\phi^l(k)$ denotes the minimum number of bits constituting any k consecutive granules in an audio bitstream, and $\phi^u(k)$ denotes the corresponding maximum number of bits. $\phi^l(k)$ and $\phi^u(k)$ can be obtained by analyzing a number of audio clips that are representative of audio clips to be processed.

Now, given an audio clip to be decoded, let x(t) denote the number of granules arriving in the internal buffer 501 over the time interval [0, t]. Because of the variability in the number of bits constituting a granule, the function x(t) will be audio clip dependent. Similar to the functions $\phi^l(k)$ and $\phi^u(k)$, two functions $\alpha^l(\Delta)$ and $\alpha^u(\Delta)$ to bound the variability in the arrival process of the granules into the internal buffer 501 may be used. The two functions $\alpha^l(\Delta)$ and $\alpha^u(\Delta)$ are defined as follows:

$$\alpha^l(\Delta) \leqq x(t+\Delta)-x(t) \leqq \alpha^u(\Delta), x(t), \text{ and } t,\Delta \geqq 0 \tag{5}$$

where $\alpha^l(\Delta)$ denotes the minimum number of granules that can arrive in the internal buffer 501 within any time interval of length Δ, and $\alpha^u(\Delta)$ denotes the corresponding maximum number.

Given the functions $\phi^l(k)$ and $\phi^u(k)$, it is possible to determine the pseudo-inverse of these two functions, denoted by $\phi^{l^{-1}}(n)$ and $\phi^{u^{-1}}(n)$, with the following interpretation. Both these functions take the number of bits n as an argument. $\phi^{l^{-1}}(n)$ returns the maximum number of granules that can be constituted by n bits and $\phi^{u^{-1}}(n)$ returns the minimum number of granules that can be constituted by n bits. Since the input bit stream arrives in the internal buffer 501 at a constant rate of r bits/sec, $\alpha^l(\Delta)$ may be defined as follows:

$$\alpha^l(\Delta)=\phi^{u^{-1}}(r\Delta) \text{ and } \alpha^u(\Delta)=\phi^{l^{-1}}(r\Delta) \tag{6}$$

Figure 6:
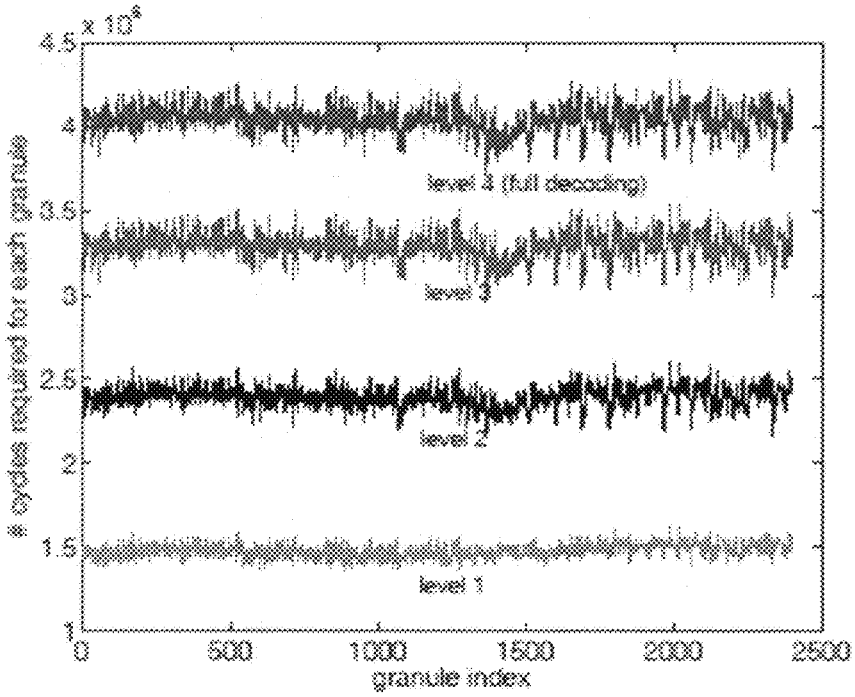
FIG. 6 is a graph showing the cycle requirement for the processor of FIG. 1 per granule, corresponding to an audio clip, for a predetermined duration.

Again, since the number of processor cycles required to process any granule is also variable, this variability may be captured using two functions $\gamma^l(k)$ and $\gamma^u(k)$. Both the functions $\gamma^l(k)$ and $\gamma^u(k)$ take the number of granules k as an argument. $\gamma^l(k)$ returns the minimum number of processor cycles required to process any k consecutive granules and $\gamma^u(k)$ returns the corresponding maximum number of processor cycles. FIG. 6 shows the cycle requirement for the processor 105 per granule, corresponding to a 160 kbits/sec bit rate audio clip, for a duration of around 30 secs. FIG. 6 shows the processor cycle requirement corresponding to the four decoding levels of Table 1. There are two points to be noted in FIG. 6: (i) the increasing processor cycle requirement as the decoding level is increased, (ii) the variability of the processor cycle requirement per granule for any decoding level.

Assuming that the playout buffer 501 is readout by the processor 105 at a constant rate of c PCM samples/sec, after a playback delay (or buffering time) of d seconds. Usually c is equal to 44.1K PCM samples/sec for each channel (and therefore, 44.1K×2 PCM samples/sec for stereo output) and d can be set to a value between 0.5 to 2 seconds. If the number of PCM samples per granule is equal to s (which is equal to 576×2), the playout rate is equal to c/s granules/second. If the function C(t) denotes the number of granules readout by the processor 105 over the time interval [0, t], then, $$C(t) = \begin{cases} 0, & t \leq d \\ \frac{c}{s} \cdot t, & t > d \end{cases}$$

Now, given the input bitrate r, the functions $\phi^l(k)$, $\phi^u(k)$, $\gamma^l(k)$ and $\gamma^u(k)$ characterizing the possible set of audio clips to be decoded, and the function C(t), the minimum processor frequency f to sustain the playout rate of c PCM samples/sec may be determined. This is equivalent to requiring that the playout buffer 501 never underflows. If y(t) denotes the total number of granules written into the playout buffer 501 over the time interval [0, t], then this is equivalent to requiring that $y(t) \geqq C(t)$ for all $t \geqq 0$.

Let the service provided by the processor 105 at frequency f be represented by the function β(Δ). Similar to $\alpha^l(\Delta)$, β(Δ) represents the minimum number of granules that are guaranteed to be processed (if available in the internal buffer 500) within any time interval of length Δ. It may be shown that $y(t) \geqq (\alpha^l \otimes \beta)(t)$, $t \geqq 0$, where $\otimes$ is the min-plus convolution operator defined as follows.

For any two functions f and g, $(f \otimes g)(t) = \inf_{0 \geqq s \geqq t}\{f(t-s)+g(s)\}$. Hence, for the constraint $y(t) \geqq C(t)$, $t \geqq 0$ to hold, it is sufficient that the following inequality holds:

$$(\alpha^l \otimes \beta)(t) \geqq C(t), t \geqq 0 \tag{7}$$

From the duality between $\otimes$ and Ø, for any three functions f, g and h, $h \geqq f Ø g$ if and only if $g \otimes h \geqq f$, where Ø is the min-plus deconvolution operator, defined as follows: $(f Ø g)(t) = \sup_{s \geqq 0}\{f(t+s)-g(s)\}$. Using this result on inequality (1), β(t) may be determined as follows:

$$\beta(t) \geqq (C Ø \alpha^l)(t), t \geqq 0 \tag{8}$$

Note that β(t) is defined in terms of the number of granules that need to be processed within any time interval of length t. To obtain the equivalent service in terms of processor cycles, the function $\gamma^u(k)$ defined above may be used. The minimum service that needs to be guaranteed by the processor 105 to ensure that the playout buffer 501 never underflows is given by:

$$\overline{\beta}(t)=\gamma^u(\beta(t))=\gamma^u((C\varnothing\alpha^l)(t))=\gamma^u(C(t)\varnothing\phi^{u^{-1}}(rt)) \quad (9)$$

processor cycles for all $t\geqq 0$. Hence, the minimum frequency at which the processor 105 should be run to sustain the specified playout rate is given by: $\min\{f|f\cdot t\geqq\overline{\beta}(t),\ \forall t\geqq 0\}$. The energy consumption while decoding an audio clip of duration t is proportional to $f^3t$, assuming a voltage and frequency scalable processor, where corresponding to any operating point, the voltage is proportional to the clock frequency.

Figure 7:
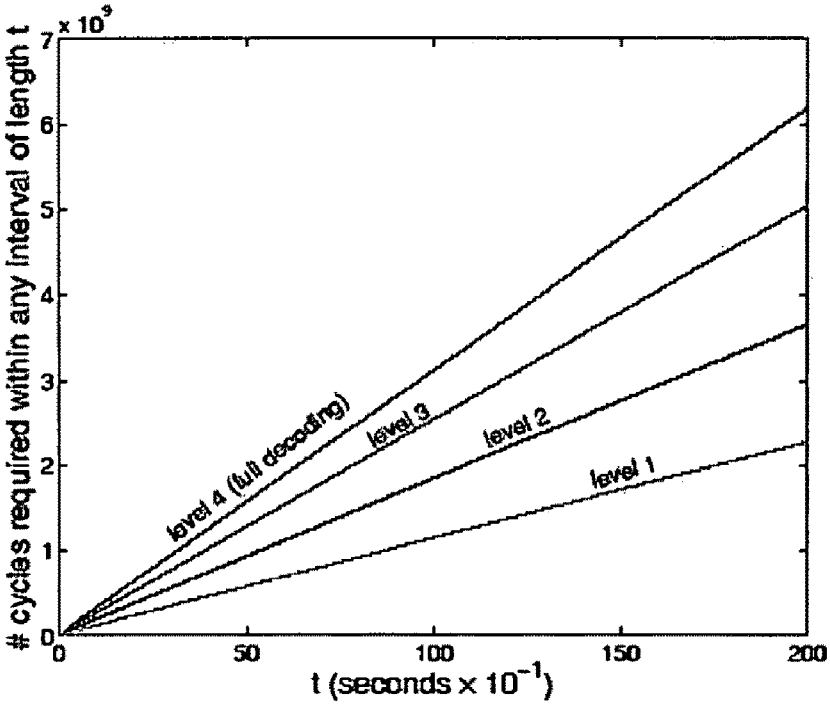
FIG. 7 shows the processor cycles required within any interval of length t corresponding to the decoding levels of the preferred embodiment.

FIG. 7 shows the processor cycles required within any interval of length t corresponding to the decoding levels of Table 1. From FIG. 7, it can be seen that each decoding level is associated with a minimum (constant) frequency f. As the decoding level is increased, the associated value of f also increases.

Supposing the processor 105 is run at a constant frequency equal to f processor cycles/sec, corresponding to some decoding level. The minimum sizes of the internal and the playout buffers 500 and 501, which will guarantee that these buffers will never overflow, may be determined. The pseudoinverse of the two functions $\gamma^l$ and $\gamma^u$, denoted by $\gamma^{l^{-1}}(n)$ and $\gamma^{u^{-1}}(n)$, respectively, may be determined. Both these finctions $\gamma^l$ and $\gamma^u$ take the number of processor cycles n as an argument. $\gamma^{l^{-1}}(n)$ returns the maximum number of granules that may be processed using n processor cycles and $\gamma^{u^{-1}}(n)$ returns the corresponding minimum number.

The minimum number of granules that are guaranteed to be processed within any time interval of length Δ, when the processor 105 is run at a frequency f, is equal to $\gamma^{u^{-1}}(f\Delta)$. It may be shown that the minimum size b of the internal buffer 500, such that the internal buffer 500 never overflows is given by $b=\sup_{\Delta\geqq 0}\{\alpha^u(\Delta)-\gamma^{u^{-1}}(f\Delta)\}$ granules.

Similarly, the maximum number of granules that may be processed within any time interval of length Δ is given by $\gamma^{l^{-1}}(f\Delta)$. It is possible to show that arrival process of granules in the playout buffer 501 is upper bounded by the function $\overline{\alpha}^u(\Delta)$, which may be determined as follows:

$$\overline{\alpha}^u(\Delta)=(\alpha^u(\Delta)\otimes\gamma^{l^{-1}}(f\Delta))\varnothing\gamma^{u^{-1}}(f\Delta),\forall\Delta\geqq 0 \quad (10)$$

where $\overline{\alpha}^u(\Delta)$ is the maximum number of granules that might be written into the playout buffer 501 within any time interval of length Δ. The minimum size of the buffer 501 (i.e, B), to guarantee that the buffer 501 never overflows can now be shown to be equal to $B=\sup_{\Delta\geqq 0}\{\overline{\alpha}^u(\Delta)-C(\Delta)\}$ granules. The sizes b and B in terms of bits and PCM samples are $\phi^u(b)$ and sB respectively.

In one implementation, the processor 105 may be an Intel XScale 400 MHz processor with the decoding levels being set according to Table 2 below.

TABLE 2

| Playback delay | Level 4 | Level 3 | Level 2 | Level 1 |
|---|---|---|---|---|
| 0.5 sec | 3.56 MHz | 2.91 MHz | 2.13 MHz | 1.33 MHz |
| 1.0 sec | 3.32 MHz | 2.71 MHz | 1.99 MHz | 1.23 MHz |
| 2.0 sec | 3.20 MHz | 2.61 MHz | 1.91 MHz | 1.19 MHz |

The aforementioned preferred method(s) comprise a particular control flow. There are many other variants of the preferred method(s) which use different control flows without departing the spirit or scope of the invention. Furthermore one or more of the steps of the preferred method(s) may be performed in parallel rather sequentially.

INDUSTRIAL APPLICABILITY

It is apparent from the above that the arrangements described are applicable to the computer and data processing industries.

The foregoing describes only some embodiments of the present invention, and modifications and/or changes can be made thereto without departing from the scope and spirit of the invention, the embodiments being illustrative and not restrictive. (Australia Only) In the context of this specification, the word "comprising" means "including principally but not necessarily solely" or "having" or "including", and not "consisting only of". Variations of the word "comprising", such as "comprise" and "comprises" have correspondingly varied meanings.

The claims defining the invention are as follows:

1. An apparatus comprising:

an audio input interface configured to receive an audio clip;

an audio decoder coupled to the audio input interface, wherein the audio decoder is configured to selectively decode the audio clip by decoding those portions of the audio clip that are within an audio frequency range corresponding to a selected one of a plurality of different audio quality levels that are available for selection, wherein each of the different audio quality levels correspond to a different audio frequency range; and an audio output interface coupled to the audio decoder, wherein the audio output interface is configured to output the selectively decoded audio clip.

2. The apparatus of claim 1, further comprising an input interface coupled to the audio decoder, wherein the input interface is configured to enable a selection of the selected one of the plurality of audio quality levels available for selection.

3. The apparatus of claim 1, wherein the audio decoder comprises a software-implemented audio decoder and the apparatus further comprises a processor configured to operate the software-implemented audio decoder.

4. The apparatus of claim 3, wherein the processor is further configured to consume a different amount of power for each of the different audio frequency ranges.

5. The apparatus of claim 3, wherein the software-implemented audio decoder is configured to perform Huffman decoding, and the processor is further configured to generate PCM samples from the Huffman decoded audio.

6. The apparatus of claim 3, wherein the processor is further configured to be scalable in processor frequency or processor voltage.

7. The apparatus of claim 1, wherein the audio frequency ranges comprise at least two audio frequency ranges selected from the group consisting of an audio frequency range of 0 to 5512.5 Hz, an audio frequency range of 0 to 11025 Hz, an audio frequency range of 0 to 16537.5 Hz, and an audio frequency range of 0 to 22050 Hz.

8. The apparatus of claim 1, wherein the plurality of audio quality levels comprise at least two audio quality levels selected from the group consisting of an AM audio quality level, an audio quality level between AM audio quality and FM audio quality, an audio quality level between FM audio quality and CD audio quality, and a CD audio quality level.

9. The apparatus of claim 1, wherein the apparatus is a battery operated apparatus.

10. The apparatus of claim 1, wherein the apparatus is one of a portable audio player, a mobile telephone, or a personal digital assistant.

11. A method comprising:

receiving, by an audio decoder, a selection of a first audio quality level corresponding to a first audio frequency range;

decoding, by the audio decoder, those portions of a first audio clip that are within the first audio frequency range;

outputting the decoded portions of the first audio clip;

receiving, by the audio decoder, a selection of a second audio quality level corresponding to a second audio frequency range different than the first audio frequency range;

decoding, by the audio decoder, those portions of a second audio clip that are within the second audio frequency range; and outputting the decoded portions of the second audio clip.

12. The method of claim 11, wherein decoding those portions of the first audio clip that are within the first audio frequency range or decoding those portions of the second audio clip that are within the second audio frequency range, or both, comprises operating a software implemented audio decoder by a processor.

13. The method of claim 12, wherein decoding those portions of the first audio clip that are within the first audio frequency range or decoding those portions of the second audio clip that are within the second audio frequency range, or both, comprises Huffman decoding by the audio decoder, and generating PCM samples from the Huffman decoded audio.

14. The method of claim 12, further comprising scaling a processor frequency or a processor voltage of the processor.

15. The method of claim 11, wherein the first audio quality level is one of an AM audio quality level, an audio quality level between AM audio quality and FM audio quality, an audio quality level between FM audio quality and CD audio quality, and a CD audio quality level, and the second audio quality level is another of an AM audio quality level, an audio quality level between AM audio quality and FM audio quality, an audio quality level between FM audio quality and CD audio quality, and a CD audio quality level.

16. The method of claim 15, wherein the first audio frequency range is one of an audio frequency range of 0 to 5512.5 Hz, an audio frequency range of 0 to 11025 Hz, an audio frequency range of 0 to 16537.5 Hz, and an audio frequency range of 0 to 22050 Hz, and the second audio frequency range is another of an audio frequency range of 0 to 5512.5 Hz, an audio frequency range of 0 to 11025 Hz, an audio frequency range of 0 to 16537.5 Hz, and an audio frequency range of 0 to 22050 Hz.

17. The method of claim 11, wherein the first audio clip and the second audio clip are the same audio clip.

18. The method of claim 11, wherein the first audio clip and the second audio clip are different audio clips.

19. An article of manufacture comprising:

a tangible, non-transitory computer-readable storage medium; and a plurality of programming instructions stored in the computer-readable storage medium, and configured to enable an apparatus, in response to execution of the programming instructions by the apparatus, to perform operations including:

receiving a selection of a first audio quality level corresponding to a first audio frequency range;

decoding those portions of a first audio clip that are within the first audio frequency range;

outputting the decoded portions of the first audio clip;

receiving a selection of a second plurality of audio quality level corresponding to a second audio frequency range different than the first audio frequency range;

decoding those portions of a second audio clip that are within the second audio frequency range; and outputting the decoded portions of the second audio clip.

20. The article of claim 19, wherein the first audio quality level is one of an AM audio quality level, an audio quality level between AM audio quality and FM audio quality, an audio quality level between FM audio quality and CD audio quality, and a CD audio quality level, and the second audio quality level is another one of an AM audio quality level, an audio quality level between AM audio quality and FM audio quality, an audio quality level between FM audio quality and CD audio quality, and a CD audio quality level.

21. The article of claim 20, wherein the first audio frequency range is one of an audio frequency range of 0 to 5512.5 Hz, an audio frequency range of 0 to 11025 Hz, an audio frequency range of 0 to 16537.5 Hz and an audio frequency range of 0 to 22050 Hz, and the second audio frequency range is another one of an audio frequency range of 0 to 5512.5 Hz, an audio frequency range of 0 to 11025 Hz, an audio frequency range of 0 to 16537.5 Hz and an audio frequency range of 0 to 22050 Hz.

22. The article of claim 19, wherein the first audio clip and the second audio clip are the same audio clip.

23. The article of claim 19, wherein the first audio clip and the second audio clip are different audio clips.

* * * * *

UNITED STATES PATENT AND TRADEMARK OFFICE

CERTIFICATE OF CORRECTION

PATENT NO. : 7,945,448 B2
APPLICATION NO. : 11/792019
DATED : May 17, 2011
INVENTOR(S) : Wang et al.

It is certified that error appears in the above-identified patent and that said Letters Patent is hereby corrected as shown below:

On the Title page, item (60), under "Related U.S. Application Data", Lines 1-2, delete "Nov. 29, 2007." and insert -- Nov. 29, 2004. --.

Page 2, item (56), under "Other Publications", Line 2, delete "2000" and insert -- 2002 --.

Page 2, item (56), under "Other Publications", Line 13, delete "ACM" and insert -- ACM, --.

Page 2, item (56), under "Other Publications", Line 25, delete "Technology" and insert -- Technologies --.

Page 2, item (56), under "Other Publications", Line 25, delete "Encylcopedia" and insert -- Encyclopedia --.

Signed and Sealed this
Ninth Day of August, 2011

David J. Kappos

David J. Kappos
*Director of the United States Patent and Trademark Office*